United States Patent [19]

Simjian

[11] 4,003,375

[45] Jan. 18, 1977

[54] EXERCISE AND MASSAGING APPARATUS

[76] Inventor: Luther G. Simjian, 7 Laurel Lane, Greenwich, Conn. 06830

[22] Filed: Nov. 17, 1975

[21] Appl. No.: 632,239

[52] U.S. Cl. ..... 128/54; 128/41; 128/32; 128/55

[51] Int. Cl.[2] ..... A61H 23/00

[58] Field of Search ..... 128/54, 55, 51, 52, 128/41, 32, 24.1, 24.2

[56] References Cited

UNITED STATES PATENTS

| | | | |
|---|---|---|---|
| 565,475 | 8/1896 | Lindahl | 128/55 |
| 3,310,050 | 3/1967 | Goldfarb | 128/41 |
| 3,424,149 | 1/1969 | Fujimoto | 128/55 |
| 3,880,153 | 4/1975 | Perrine | 128/55 |
| 3,896,795 | 7/1975 | Solhkhah | 128/32 |

*Primary Examiner*—Laurence W. Trapp

[57] ABSTRACT

An exercise and massaging apparatus in the form of a stationary bicycle includes a belt having movable striking elements. When the belt is worn and pedal means are operated, the striking elements repetitively impact upon the wearer of the belt.

11 Claims, 9 Drawing Figures

EXERCISE AND MASSAGING APPARATUS

BRIEF SUMMARY OF THE INVENTION.

This invention refers to an exercise apparatus combined with massaging means as described in my prior U.S. Pat. No. 3,727,608; 3,777,745; 3,861,382; 3,899,115; 3,915,158; 3,915,159, and pending applications Ser. No. 523,565 and 594,640.

In the prior patents and applications I have disclosed an exercise apparatus, typically a stationary bicycle, which when operated by a person imparts motion to a massaging means, such as a belt, encircling the torso of the person undergoing the exercise. The belt is provided with resilient flexible massaging elements which reciprocatingly roll over the engaged torso portion at a speed determined by the speed imparted to the pedals of the bicycle. Thus, the massaging effect is directly related to the muscular effort of the person.

The present invention discloses an alternative construction for an exercise apparatus of the type indicated, but is characterized in that the massaging elements associated with the belt comprise striking elements which, responsive to the operation of the pedal means, periodically paddle or strike the person at the portion about which the belt is secured. Other constructional features of the present invention may more clearly be apparent by reference to the following description when taken in conjunction with the accompanying drawings.

DETAILED DESCRIPTION.

Figure 1:
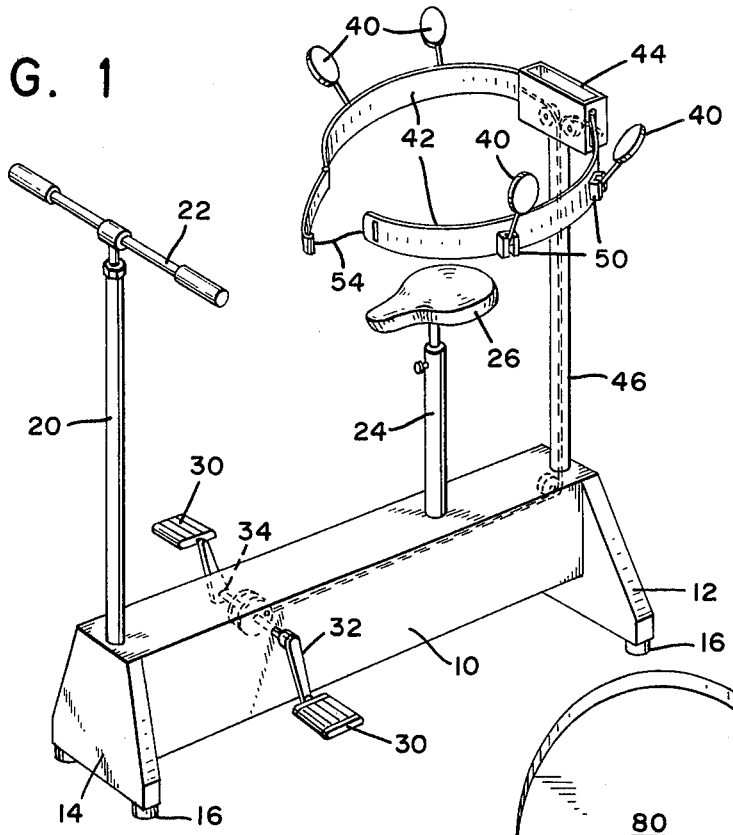
FIG. 1 is a perspective view of the present apparatus.

Referring now to the figures and FIG. 1 in particular, there is shown a stationary support 10 which is supported upon a supporting surface, such as the floor of a room, by a set of end plates 12 and 14, each having a pair of feet 16. A post 20 upstanding from the support 10 supports a handle bar 22 and a further post 24 supports in raised position from the support 10 a seat 26. The height off the seat 26 is adustable by conventional means. The support 10 supports, moreover, a set of bicycle type pedals 30 which are fastened to respective crank arms 32 which, in turn, are secured to a horizontally disposed pedal shaft 34, see also FIG. 9.

Motion of the pedals 30 and pedal shaft 34 is transmitted to the plurality of striking elements 40 which are individually attached to a belt 42. The belt 42 can be secured around a portion of a person operating the pedals while being seated on the seat 26 and supporting himself at the handle bar 22. Typically, the belt 42 is secured around the torso of the person. The belt 42 is supported by means of a box-like enclosure 44 secured to the upper end of a post 46 which extends from the support 10. It may be noted that the support 10 together with pedals 30, seat 26 and handle bar 22 is arranged in the form of a stationary bicycle as is well known in the art of exercise apparatus.

Figure 2:
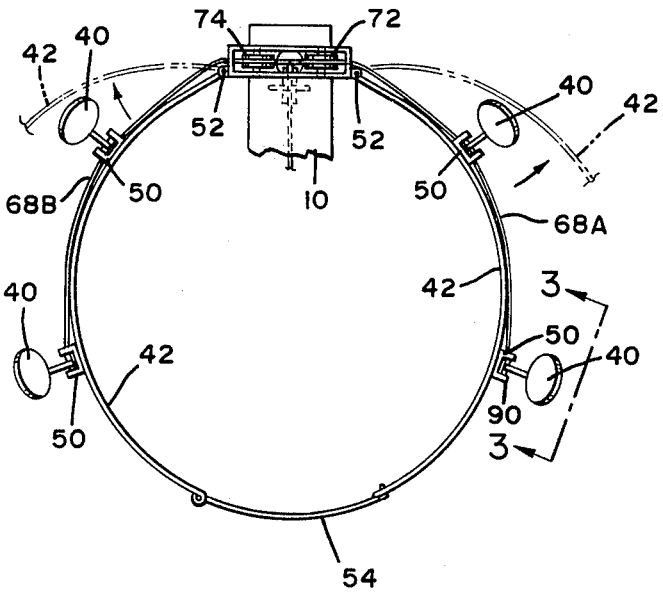
FIG. 2 is a top plan view of the belt having the plurality of striking elements.

The construction of the belt 42 is more clearly apparent by reference to FIG. 2 which indicates the plurality of striking elements 40 secured to the belt 42 by means of individual brackets 50 which will be explained in greater detail in connection with FIGS. 3 and 4. The belt 42 comprises two half sections, each hinged by virtue of a hinge 52 fastened to the enclosure 44. Additionally, the half sections of the belt can be fastened together by a clasp 54 or other suitable means.

Figure 7:
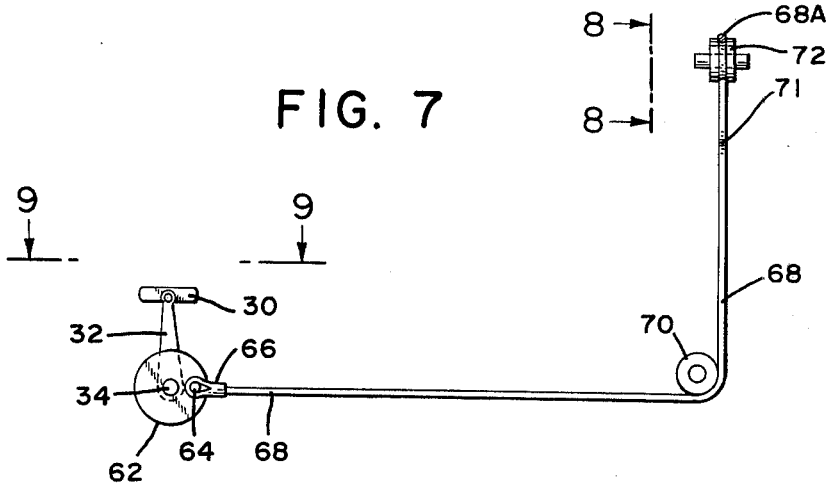
FIG. 7 is an elevational view showing the coupling mechanism between the pedal means in FIG. 1 and the striking elements of the belt.
Figure 8:
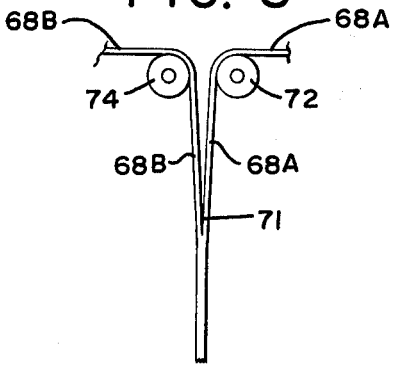
FIG. 8 is a view along line 8—8 in FIG. 7.
Figure 9:
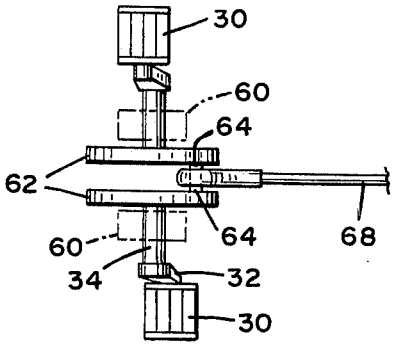
FIG. 9 is a top plan view along line 9—9 in FIG. 7.

Referring to FIG. 9, the pedal shaft 34 is journalled in a pair of bearing supports 60 within the support 10. The pedal shaft 34 is split and each portion is provided with a disk 62 and such disks being jointed by an eccentrically located pin 64. An eye 66, FIG. 7, encircles the pin 64 and forms one end of a flexible cable, band or rope 68. The band 68 continues horizontally over a fixed center mounted pulley 70 and then is directed upwardly in the post 46, see FIGS. 1 and 7, being split at 71 into a portion 68A and a portion 68B as seen in FIG. 8. The enclosure 44 contains a set of fixed center mounted rollers 72 and 74, and, as seen in FIG. 8, the band portion 68A is fed over roller 72 toward the right and the portion 68B is fed over the roller 74 toward the left. It will be apparent that the rotating motion imparted to the pedals 30 by means of the eccentric pin 64, see FIGS. 7 and 9, is converted to a reciprocating motion which is transmitted upward to the belt 42 where the respective band portions actuate the striking elements 40.

Figure 3:
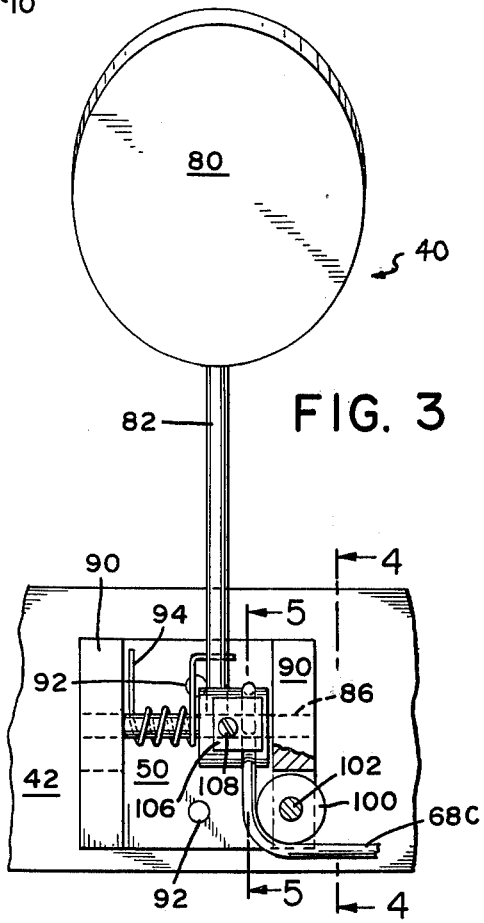
FIG. 3 is a view along line 3—3 in FIG. 2.
Figure 4:
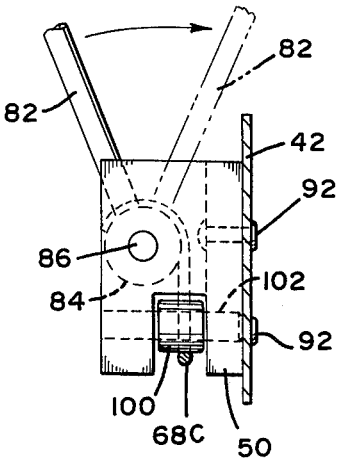
FIG. 4 is a view along line 4—4 in FIG. 3.
Figure 5:
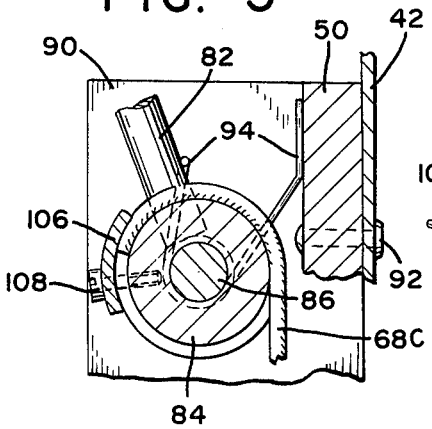
FIG. 5 is a sectional view along line 5—5 in FIG. 3.

Referring now to FIGS. 3, 4 and 5, each striking element 40 comprises a paddle 80 which is fastened to a stem 82. The other end of the stem 82 is secured to a roller 84. The roller 84 is carried on a shaft 86 which is supported by the ears 90 of the U-shaped bracket 50. The bracket 50 is fastened to the belt 42 by one or more rivets 92, as clearly seen in FIG. 3. A torsion spring 94 carried by the shaft 86 and engaging with one end the bracket 50 and with the other end the stem 82 biases the striking element 80 and stem 82 outwardly toward a position away from impact with the wearer of the belt. The end of the belt 68C is fed about a roller 100 carried by a shaft 102, see FIG. 3, wound partially around the roller 84 and clamped to the roller 84 by means of a plate 106 and screw 108. Thus, responsive to the operation of the pedal means 30, the end of the rope or band 68C is alternately pulled and relaxed, thereby causing pivotal motion of the striking element 80 and its stem 82 about an angle substantially as shown in FIG. 4.

Figure 6:
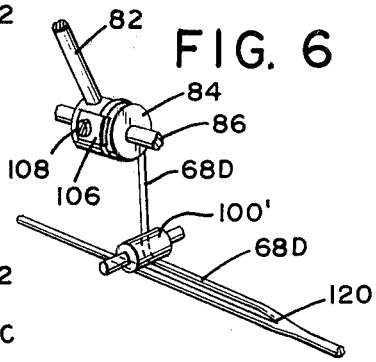
FIG. 6 is a perspective view showing the mechanism for operating an intermediate striking element.

FIG. 6 discloses the actuation of a typical striking element disposed intermediate between the enclosure 44 and the most distant striking element 40. For this purpose the rope or band is split once again as shown for instance at point 120, and a further branch rope portion 68D is fed over the roller 100' to a support 50 which contains a respective shaft 86, roller 84 and stem 82. As clearly evident and described previously, the operation of the motive means, in this case the pedal means 30, provides alternate pulling and relaxing of the flexible band or rope ends which, in turn, periodically pull upon the rollers 84 so as to cause pivotal motion of the striking element from a position away from the body of the wearer toward impact with the wearer of the belt. The biasing means in the form of a torsion spring 94 cause the striking elements to be normally retained in a position away from impact.

While the foregoing specification describes and illustrates a preferred embodiment of my invention it will be apparent to those skilled in the art that various changes and modifications may be made without deviating from the principle of my invention which shall be limited only by the scope of the appended claims.

What is claimed is:

1. An exercise and massaging apparatus comprising:

a stationary support;

motive means in the form of pedal means mounted to said support;

a belt adapted to be secured to a person, said belt including a plurality of movable striking elements, and coupling means coupling said pedal means to said striking elements for causing responsive to the operation of said pedal means said striking elements to periodically undergo motion for striking the person.

2. An exercise and massaging apparatus as set forth in claim 1, said coupling means including means for converting rotating motion imparted to said pedal means to reciprocating motion.

3. An exercise and massaging apparatus as set forth in claim 2, said striking elements being in the form of respective paddles.

4. An exercise and massaging apparatus as set forth in claim 2, and resilient means coupled to said striking elements for biasing each element in a direction away from striking the person.

5. An exercise and massaging apparatus as set forth in claim 4, each element being mounted for motion from a position away from striking the person to a position in contact with the person.

6. An exercise and massaging apparatus as set forth in claim 1, said striking elements being spaced from another along the length of the belt; each striking element being mounted to a roller for pivotal motion toward and away from said person, and resilient means disposed for biasing each of said elements in a direction away from said person.

7. An exercise and massaging apparatus as set forth in claim 6, said coupling means including means for converting rotating motion imparted to said pedal means to reciprocating motion, and including flexible cord means for cyclically imparting pivotal motion to each of said rollers for causing each roller in response to operation of said motive means to move the associated element to periodically strike said person.

8. An exercise and massaging apparatus as set forth in claim 7, each striking element comprising a stem extending with one end from the respective roller and having a paddle at its other end.

9. An exercise and massaging apparatus as set forth in claim 8, said stationary support supporting a seat and a handle bar in raised position from said support; said pedal means mounted to a horizontally disposed shaft adapted to be rotated by the person sitting on said seat and supporting himself at said handle bar, and said coupling means being coupled to said shaft.

10. An exercise and massaging apparatus comprising:

a stationary support;

pedal means mounted to said support for operation by a person disposed on said support;

a belt supporting a plurality of paddle like striking elements which are disposed for contacting a person wearing said belt, and coupling means coupling said pedal means to said striking elements for causing responsive to the rotation of said pedal means said striking elements periodically undergo pivotal motion for striking a person wearing said belt and operating said pedal means.

11. An exercise and massaging apparatus as set forth in claim 10, said stationary support being in the form of a stationary bicycle and including a seat and a handle bar.

* * * * *